United States Patent [19]

Gartner

[11] Patent Number: 4,486,992

[45] Date of Patent: Dec. 11, 1984

[54] WATER-TIGHT APPARATUS FOR A CROSSED PORTION OF A UNIT TYPE CURTAIN WALL

[75] Inventor: Karl Gartner, Gundelfingen, Fed. Rep. of Germany

[73] Assignee: Yoshida Kogyo, K.K., Tokyo, Japan

[21] Appl. No.: 519,188

[22] Filed: Aug. 1, 1983

[30] Foreign Application Priority Data

Aug. 2, 1982 [JP] Japan ..... 57-116165

[51] Int. Cl.[3] ..... E04H 1/00

[52] U.S. Cl. ..... 52/235; 52/464

[58] Field of Search ..... 52/235, 488, 461, 464, 52/509

[56] References Cited

U.S. PATENT DOCUMENTS 3,093,217 6/1963 Doede ..... 52/235 X 3,316,681 5/1967 Eber ..... 52/235

3,672,107 6/1972 Santry et al. ..... 52/235

*Primary Examiner*—Carl D. Friedman

*Assistant Examiner*—Naoko Nakazawa

*Attorney, Agent, or Firm*—Hill, Van Santen, Steadman & Simpson

[57] ABSTRACT

A water-tight device in a crossed portion of a unit type curtain wall in which unit curtain wall units are mounted at top and bottom and to left and right. The water-tight device has a pair of external horizontal packings for connecting respective vertical frame units of the unit curtain wall units adjacent to left and right each other, a connecting member for connecting respective horizontal frame units of the unit curtain wall units adjacent to top and bottom each other, and a connecting plate connected between the vertical frame units adjacent to top and bottom and between the connecting members adjacent to left and right.

5 Claims, 5 Drawing Figures

WATER-TIGHT APPARATUS FOR A CROSSED PORTION OF A UNIT TYPE CURTAIN WALL

BACKGROUND OF THE INVENTION

1. Field of the Invention

This invention relates to an apparatus for holding water-tight a connecting portion of a unit type curtain wall, and more particularly to an apparatus for holding water-tight a crossed portion of curtain wall units adjacent to top and bottom and left and right in a unit type curtain wall in which curtain wall units are mounted in directions of top and bottom and left and right.

2. Description of the Prior Art

It is well known that connecting portions of not only a unit type curtain wall but also all curtain walls are so constructed that a relative displacement between the curtain walls themselves or respective layers of a building (relative storey displacement) due to shocks of earthquake can be absorbed thereinto. On the contrary, it is little known that the connecting portions are held in water-tight. And, further, it is difficult in the unit type curtain wall to hold water-tight the crossed portion of the curtain wall units adjacent to top and bottom and left and right.

That is, portions between vertical frame units adjacent to left and right, between horizontal frame units adjacent to top and bottom and between the vertical frame unit and the horizontal frame unit have to be held water tight, and therefore it is difficult to hold the crossed portion water-tight.

SUMMARY OF THE INVENTION

The present invention has been achieved in view of the above-described circumstances, and it is an aspect of the invention to provide a water-tight apparatus for a crossed portion of a unit type curtain wall which can positively hold water tight the crossed portion of the curtain wall units adjacent to top and bottom and left and right and can prevent entry of rain water or the like into a building.

To achieve the foregoing aspect, in accordance with the present invention, there is provided a water-tight device in a crossed portion of a unit type curtain wall in which a vertical frame unit composed of vertical frame members and battens thereof and a horizontal frame unit composed of horizontal frame members and battens thereof are rectangularly connected and are mounted at top and bottom and to left and right, said water-tight device comprises a pair of external horizontal packings for connecting said vertical frame units adjacent to left and right each other, a connecting member for connecting said horizontal frame units adjacent to top and bottom each other, and a connecting plate connected between the vertical frame units adjacent to top and bottom and between the connecting members adjacent to left and right.

Further, in accordance with the present invention, there is provided a water-tight device in a crossed portion of a unit type curtain wall characterized in that spaces between said horizontal frame units adjacent to top and bottom and between said pair of external horizontal packings are brought into communication with the exterior, while being maintained to be water-tight, so as to assume an atmospheric pressure equal to that of the exterior.

Further, in accordance with the present invention, there is provided a water-tight device in a crossed portion of a unit type curtain wall characterized in that the device further comprises a further internal horizontal packing for connecting said vertical frame units adjacent to left and right each other.

Further, in accordance with the present invention, there is provided a water-tight device in a crossed portion of a unit type curtain wall characterized in that said connecting member comprises an outwardly and downwardly slightly inclined upper wall, inner and outer walls which extend substantially vertically and downwardly from both inner and outer edges of said upper wall, a lower wall connected between said inner and outer walls in an approximately intermediate portion therebetween, a protruded hook member formed in a substantially intermediate portion of said upper wall to engage an inside of the batten of said horizontal frame member, and an upper protruded member which extends vertically and upwardly from the inner edge of said upper wall and is fitted into a mounting groove at a lower end of said upper horizontal frame unit through an elastic retainer, wherein said the lower end of said inner wall is fitted vertically displaceably into a mounting groove at an upper end of said lower horizontal frame unit through an elastic retainer, and the lower end of said outer wall is connected to an outer wall surface of the batten of said lower horizontal frame unit through a seal which allows air to pass through.

Further, in accordance with the present invention, there is provided a water-tight device in a crossed portion of a unit type curtain wall characterized in that said connecting plate comprises an outwardly and downwardly slightly inclined upper wall portion which has a shape analogous in section to a shape which excludes the inner side wall, the lower wall and the protruded hook member from said connecting member, an upwardly directed piece which extends upwardly from the end edge internally of said upper wall portion, and a hanging piece which extends substantially vertically downwardly from the end edge externally of said upper wall portion, wherein each of said constituting elements are respectively closely attached to inner portions of similar corresponding portions of said connecting member.

Further, in accordance with the present invention, there is provided a water-tight device in a crossed portion of a unit type curtain wall characterized in that said seal which allows air to pass through comprises mohair which is mounted on a recessed groove formed internally and downwardly of the outer wall of said connecting member.

Still further, in accordance with the present invention, there is provided a water-tight device in a crossed portion of a unit type curtain wall characterized in that the lower portion of the outer wall of said connecting member is a portion separated from the outer wall and has a hanging piece mounted by means of a screw bolt.

BRIEF DESCRIPTION OF THE DRAWINGS

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
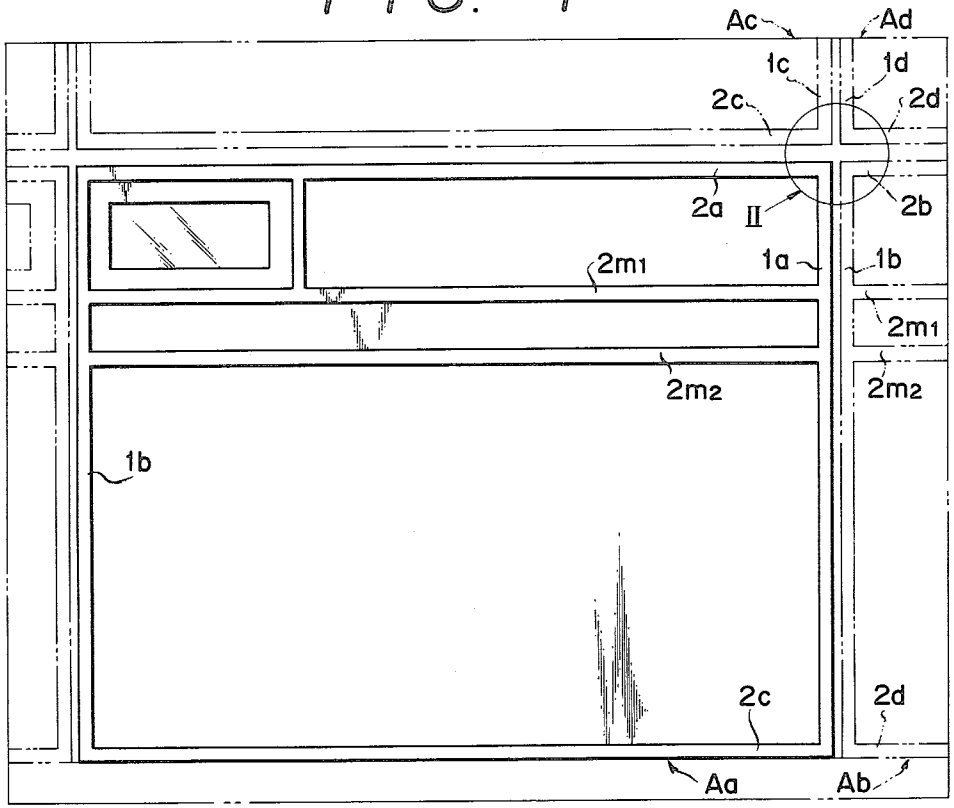
FIG. 1 is a front view showing only a skeleton of a curtain wall.

Reference is now made to FIG. 1 which is a front view showing only a skeleton of a curtain wall. Curtain wall units Aa, Ab, Ac and Ad are mounted at top and bottom and left and right to constitute a unit type curtain wall. The curtain wall unit Aa is formed into a square frame by means of a pair of vertical frame members 1*a*, 1,*b*, an upper horizontal frame member 2*a*, first and second intermediate frame members $2m_1$, $2M_2$ and a lower horizontal member 2*c*.

Figure 2:
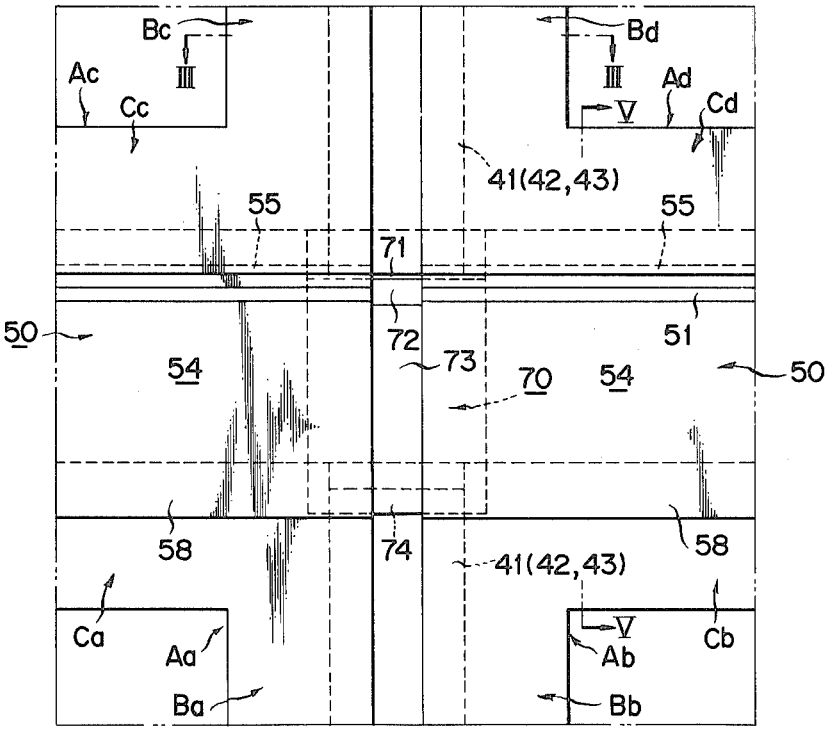
FIG. 2 is an enlarged detailed view of a II portion of FIG. 1.

FIG. 2 is a detailed front view of a portion indicated at II (a crossed portion of top and bottom and left and right curtain wall units Aa, Ab, Ac and Ad) in FIG. 1. Externally of vertical frame members 1*a* to 1*d* and horizontal frame members 2*a* to 2*d* are connected vertical and horizontal battens 31, respectively, to constitute vertical frame units Ba, Bb, Bc and Bd and horizontal units Ca, Cb, Cc and Cd.

Figure 3:
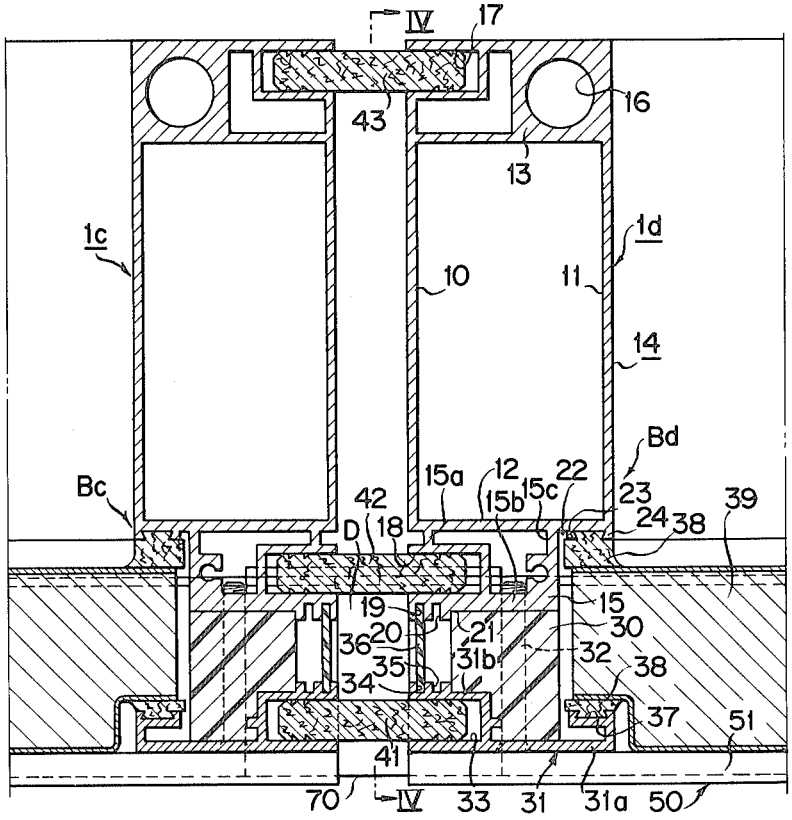
FIG. 3 is a sectional view taken on line III—III of FIG. 2.

Each of the vertical frame units Ba to Bd is constructed as shown in FIG. 3 which shows the units Bc and Bd. That is, a body 14 in the form of a hollow lengthy member is composed of both longer side walls 10, 11 and both shorter side walls 12, 13. The shorter side wall 12 is formed with a mounting piece 15 as a vertical member 1, while another shorter side wall 13 is formed with a longitudinally continuous hollow portion 16 and a recess 17 open towards said longer side wall 10, said mounting piece 15 having a Z-shaped wall 15*a* formed with a first large mounting recess 18 and an end wall 15*b* perpendicular to said Z-shaped wall 15*a* formed with second and third small mounting recesses 19, 20, said end wall 15*b* being formed with a shoulder 21, another side wall 15*c* and said shorter side wall 12 of the body 14 being formed with a shoulder 22, said shorter side wall 12 being integrally formed with a pair of locking projections 23, 24. A batten 31 is mounted on the end wall 15*b* of the mounting piece 15 by means of screw bolts 32 through a longitudinally continuous material 30 of the vertical frame member 1*c* or 1*d*, the batten 31 having an outer end wall 31*a* integrally formed with a bended wall 31*b* bended in the form of a hook to form a fourth large recess 33, the bended wall 31*b* being formed with fifth and sixth recesses 34, 35 opposed to the second and third mounting small recesses 19, 20 of the mounting piece 15, the second small mounting recess 19 and the fifth recess 34 having connecting members 36, respectively, of a heat insulating material fitted therein to constitute the vertical frame unit Bc (or Bd, Ba or Bb).

Air-tight members 38, 38 are mounted between the pair of locking projections 23, 24 and on a recess 37 formed in the outer end wall 31*a* of the batten 31, a panel 39 is held between the air-tight members 38, 38.

In the respective vertical frame units Bc, Bd (or Ba, Bb) of the curtain wall units Ac, Ad (or Aa, Ab) adjacent to left and right, their respective large mounting recesses 17, 18 and 33 are opposedly mounted as shown in FIG. 3, and a pair of outer packings 41, 42 and an inner packing 43 are fitted in and mounted between the opposed recesses to hold water-tight and connect the vertical frame units Bc, Bd (or Ba, Bb) adjacent to left and right.

Figure 4:
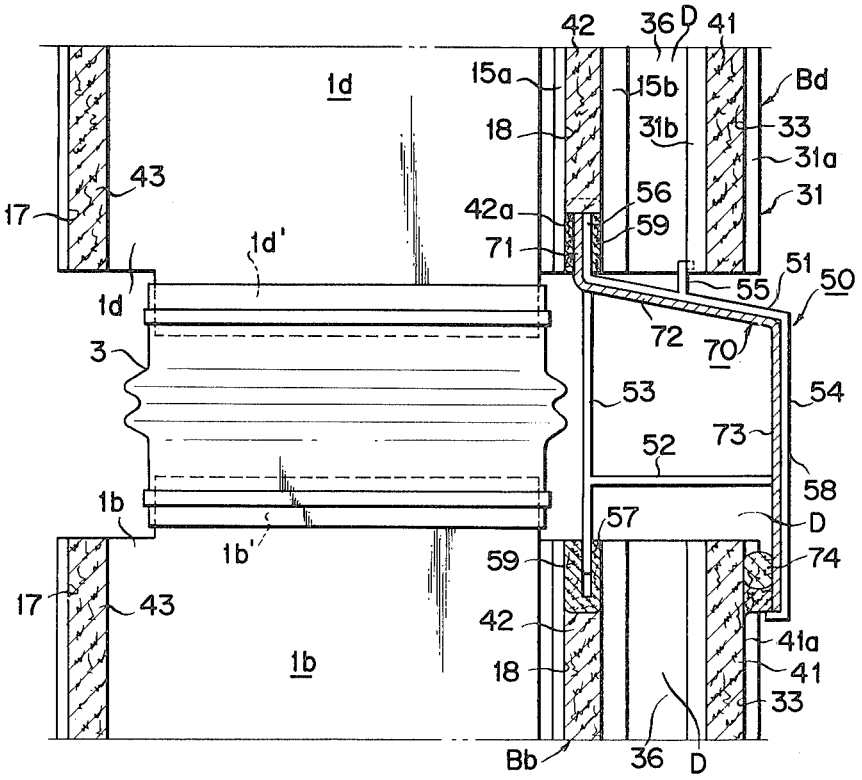
FIG. 4 is a sectional view taken on line IV—IV of FIG. 3.

In the vertical frame units Bb, Bd adjacent top and bottom, their respective vertical frame members 1*b*, 1*d* are formed with projections 1*b*', 1*d*', respectively, as shown in FIG. 4 said projections being connected each other by means of a flexible cylindrical member 3 such as, for example, bellows.

Figure 5:
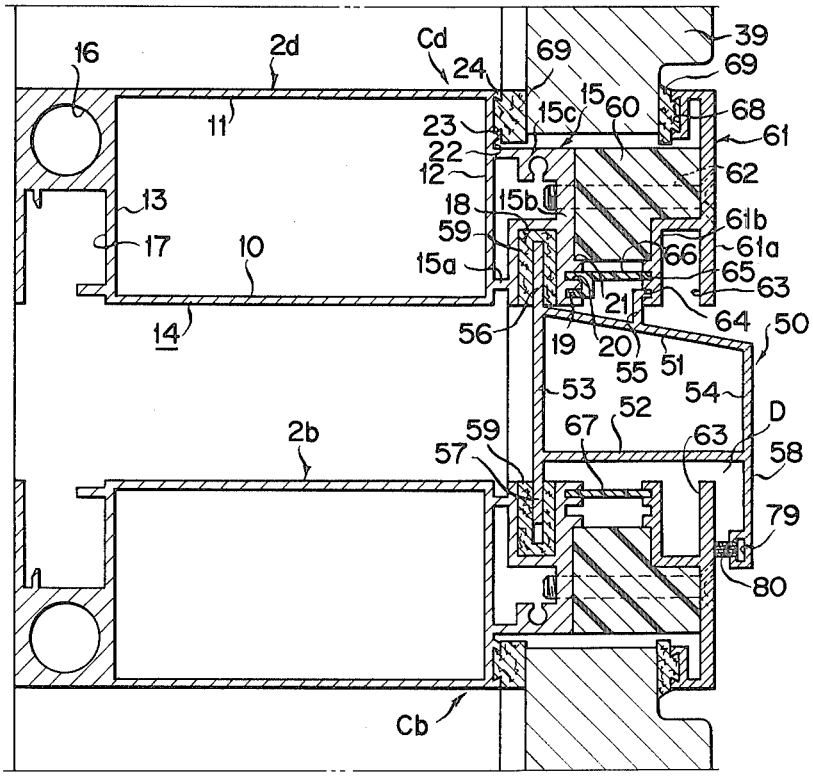
FIG. 5 is a sectional view taken on line V—V of FIG. 2.

Since each of the horizontal frame units Ca to Cd has the substantially same shape as that of the vertical frame units Ba to Bd as shown in FIG. 5 in which the units Cb and Cd are illustrated, the elements thereof are indicated by the same reference numerals as those used in the vertical frame units and the description thereof will be omitted.

The pair of curtain wall units Aa and Ac or Ab and Ad adjacent to top and bottom are connected by means of a unit connecting member 50.

The unit connecting member 50 is provided with an upper wall 51, a lower wall 52, and inner and outer walls 53, 54 formed on each side of the upper and lower walls 51 and 52, the upper wall 51 being in a gradual descent outwardly and being integrally formed with an upward hook 55 at an approximately intermediate portion thereof, the inner wall 53 being integrally formed at its upper and lower portions with upper and lower projections 56, 57, and the outer wall 54 being integrally formed with a hanging piece 58.

It will be noted that the hanging piece 58 can be fixed by means of a screw separately from the outer wall 54.

The upper projection 56 is fitted and locked in the first large mounting recess 18 of the upper horizontal frame unit Cd through a downwardly directed C-shaped holding member 59 made of an elastic material, the upward hook 55 is locked in the recess 34 of the batten 31, and the upper portion of the unit connecting member 50 is locked and secured to the upper horizontal frame unit Cd. The lower projection 57 is fitted displaceably up and down into the first large mounting recess 18 of the lower horizontal frame unit Cb through an upwardly directed C-shaped holding member 59 of an elastic material, a seal material 80 such as, for example, mohair, through which air passes, mounted on the recess 79 formed in the hanging piece 58 is pressed against the outer wall 61*a* of the batten 61, and a space D formed between the pair of horizontal outer packings 41, 42 and the upper and lower frame units is in communication with outside.

By this, the unit type curtain wall of the present invention comprises a constant atmospheric pressure wall to positively prevent entry of rain water or the like into the interior.

The left and right unit connecting members 50, 50 extend up to the opposed walls of the vertical frame units Ba, Bb and Bc, Bd resulting in a discontinuity in left and right as shown in FIG. 2 to produce a clearance between the left and right connecting members 50 and 50.

To complement this clearance, a connecting plate 70 is mounted over and between internal surfaces of the left and right unit connecting members 50 and 50 as shown in FIGS. 2 and 4 to hold water-tightness of said clearance.

The connecting plate 70 is configured to the connecting member 50 except the lower wall 52, inner wall 53 and the upward hook 55 to be in close contact with the inner surfaces of the upper projection 56, upper wall 51, outer wall 54 and hanging piece 58 of the unit connecting member 50 by an upwardly directed piece 71, an outwardly descended piece 71 and a hanging piece 73, the upwardly directed piece 71 having a longitudinal intermediate portion fitted into the first large mounting recesses 18, 18 of the upper vertical frame units Bc, Bd, respectively, so that it is pressed against the lower end 42*a* of one of the horizontal outer packings 41, 42, both longitudinal ends thereof being fitted and locked together with the upper projection 56 within the holding member 59 of the left and right upper horizontal frame units Cc, Cd, and the hanging piece 73 being pressed through a seal material 74 against the outer surface 41*a* of the other horizontal outer packing 41 of the lower vertical frame units Ba, Bb.

What is claimed is:

1. A water-tight device in a crossed portion of a unit type curtain wall wherein vertical frame units composed of vertical frame members and battens therefor and horizontal frame units composed of horizontal frame members and battens therefor are rectangularly connected and are mounted at top and bottom and to left and right, said water-tight device comprises a pair of external packings for connecting between said vertical frame units adjacent to left and right of each other, a connecting member for connecting between said horizontal frame units adjacent to top and bottom of each other, and a connecting plate connected vertically between the top and bottom vertical frame units and horizontally between the left and right connecting members, and wherein spaces between said horizontal frame units adjacent to top and bottom of each other and between said pair of external packings are in communication with the exterior, while being maintained water-tight, so as to assume an atmospheric pressure equal to that of the exterior.

2. A water-tight device in a crossed portion of a unit type curtain wall according to claim 1, characterized by further comprising a further internal horizontal packing for connecting said vertical frame units adjacent to left and right of each other.

3. A water-tight device in a crossed portion of a unit type curtain wall according to claim 1, characterized in that said connecting member comprises an outwardly and downwardly slightly inclined upper wall, inner and outer walls which extend substantially vertically and downwardly from both inner and outer edges of said upper wall, a lower wall connected between said inner and outer walls in an approximately intermediate portion therebetween, a protruded hook member formed in a substantially intermediate portion of said upper wall to engage an inside of the batten of said horizontal frame member, and an upper protruded member which extends vertically and upwardly from the inner edge of said upper wall and is fitted into a mounting groove at a lower end of said upper horizontal frame unit through an elastic retainer, wherein said the lower end of said inner wall is fitted vertically displaceably into a mounting groove at an upper end of said lower horizontal frame unit through an elastic retainer, and the lower end of said outer wall is connected to an outer wall surface of the batten of said lower horizontal frame unit through a seal which allows air to pass through.

4. A water-tight device in a crossed portion of a unit type curtain wall according to claim 3, characterized in that said connecting plate comprises an outwardly and downwardly slightly inclined upper wall portion which has a shape analogous in section to a shape which excludes the inner side wall, the lower wall and the protruded hook member from said connecting member, an upwardly directed piece which extends upwardly from an internal end edge of said upper wall portion, and a hanging piece which extends substantially vertically downwardly from an external end edge of said upper wall portion, wherein each of said constituting elements are respectively closely attached to inner portions of similar corresponding portions of said connecting member.

5. A water-tight device in a crossed portion of a unit type curtain wall according to claim 3, characterized in that said seal which allows air to pass through comprises mohair which is mounted on a recessed groove formed internally and downwardly of the outer wall of said connecting member.

* * * * *